United States Patent [19]

Meier

[11] Patent Number: 4,599,952

[45] Date of Patent: Jul. 15, 1986

[54] COMBUSTION CHAMBER

[75] Inventor: Hans-Joachim Meier, Wesel, Fed. Rep. of Germany

[73] Assignee: Deutsche Babcock Werke Aktiengesellschaft, Oberhausen, Fed. Rep. of Germany

[21] Appl. No.: 707,651

[22] Filed: Mar. 4, 1985

[30] Foreign Application Priority Data

Mar. 13, 1984 [DE] Fed. Rep. of Germany ..... 3409106

[51] Int. Cl.[4] ..... F23J 3/00

[52] U.S. Cl. ..... 110/216; 110/217

[58] Field of Search ..... 110/216, 217; 55/343, 55/483, 484

[56] References Cited

U.S. PATENT DOCUMENTS 4,055,125 10/1977 Mallek ..... 110/216

4,532,871 8/1985 Van Gasselt et al. ..... 110/216

*Primary Examiner*—Edward G. Favors

*Attorney, Agent, or Firm*—Max Fogiel

[57] ABSTRACT

The flue gases, which are generated in a combustion chamber through combustion of solid fuels, particularly under increased pressure, are cleared of dust in a dust removal device which consists of a plurality of tubular ceramic filter elements open at one side. These filter elements are suspended in a plate, which represents the ceiling of the combustion chamber.

3 Claims, 1 Drawing Figure

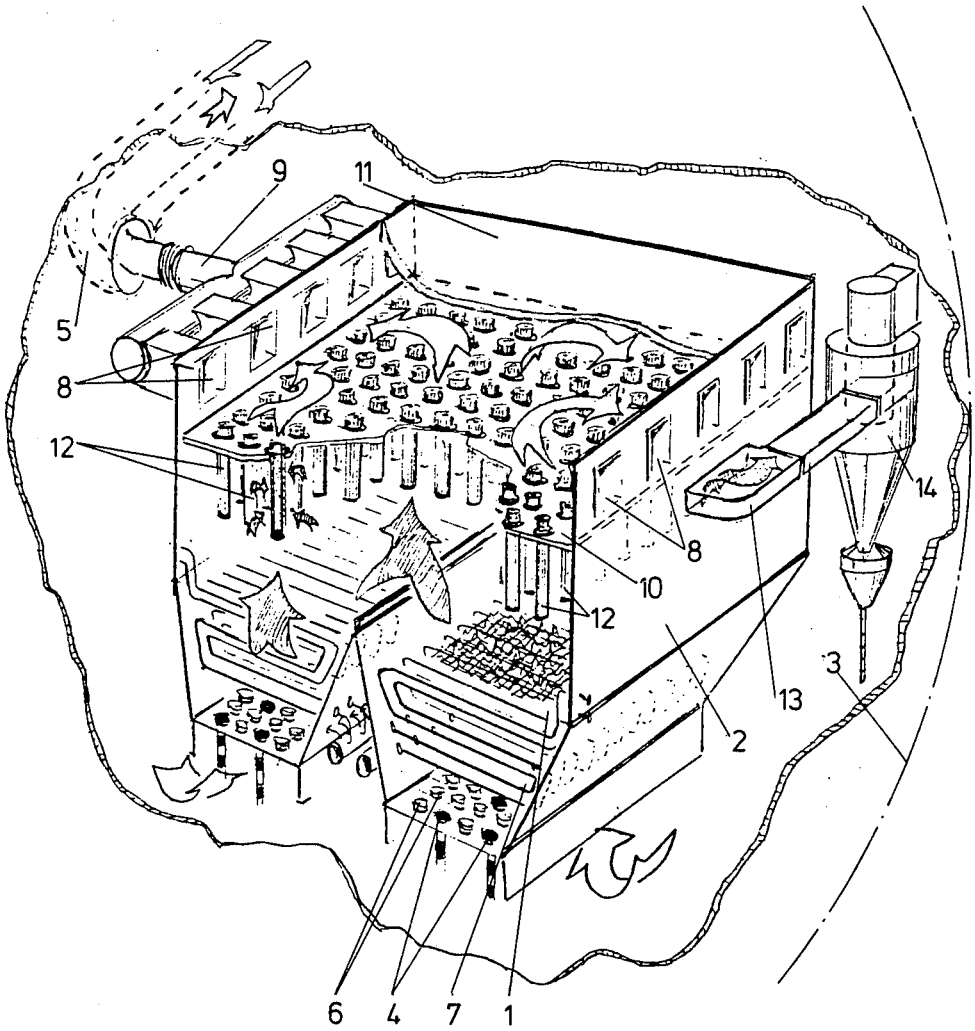
9
11
5
8
12
14
8
10
12
3
13
2
6
4
7
1

COMBUSTION CHAMBER

BACKGROUND OF THE INVENTION

The present invention concerns a combustion chamber for the combustion of solid fuels, particularly under increased pressure. A gas outlet is arranged at an upper end of the combustion chamber and is adjoined by dust removal equipment.

Cyclones, which are arranged laterally at the combustion chamber, are employed as dust removal device in a known combustion chamber (VGB Kraftwerkstechnik 60 (1980), pages 374 to 376). The cleaned gases are conducted to a gas turbine. This installation distinguishes itself by a high thermodynamic efficiency. It still lets itself be improved, however, in apparatus in some points. Since the combustion chamber is arranged in a pressure-resistant containment, the cyclones arranged externally of the combustion chamber demand space, through which the external dimensions of the containment are increased. The cyclones, which are flowed through by the hot dust-laden gases, are subject to an increased wear.

A device for the separating of suspended radio-active particles from a gas stream with the aid of tubular filter elements is known from the British patent GB-PS 14 71 606. The filter elements are produced of sintered metal and arranged in a channel flowed through by the gases to be cleaned.

SUMMARY OF THE INVENTION

The present invention is based on the task of equipping a combustion chamber according to the species with a space-saving dust removal device of low wear.

The object of the present invention is achieved by providing a combustion chamber for the combustion of solid fuels, particularly under increased pressure, with a gas outlet which is arranged at the upper end of the combustion chamber and adjoined by a dust removal device. The dust removal device has a plurality of tubular ceramic filter elements which are open at one side and suspended at a plate (10). The plate is arranged before the gas outlet and forms the ceiling of the combustion chamber. A gas collecting chamber is provided with a gas duct (9) at two opposite sides and is arranged above the plate. A closable duct is connected with a dust separator and is connected to the combustion chamber underneath the plate.

In the combustion chamber according to the present invention, the filter elements can be arranged within the combustion chamber so that the external dimensions of the combustion chamber inclusive of the dust removal device can be reduced. Since the filter elements are not flowed through by a gas set into circulation, they are subject to a lower wear than the cyclones of the known chamber.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

A perspective illustration showing a combustion chamber according to the present invention.

DESCRIPTION OF THE PREFERRED EMBODIMENTS

A fluidized bed combustion chamber with two fluidized beds 1 is illustrated as the combustion chamber. The combustion chamber is bounded by enclosing walls 2 and arranged within a pressure-resistant containment 3.

Fuel in the form of coal dust is pneumatically conducted to the fluidized beds 1 by way of fuel nozzles 4 in the base of the fuel beds 1. Combustion air is conducted under pressure through a double-walled pipe 5, of which only one is ilustrated, into the containment 3. The combustion air enters through base nozzles 6 into the fluidized beds 1. Immersed heating surfaces 7, in which steam is generated, are arranged within the fluidized beds 1.

The flue gases generated in the combustion chamber issue from a gas outlet. The gas outlet is arranged in the upper part of the combustion chamber and consists of openings 8 in two mutually opposite enclosing walls 2. A gas duct 9, which leads through the air-conducting double-walled pipe 5 to a not illustrated gas turbine, is connected to the respective openings 8 of each enclosing wall 2.

A plate 10, which is connected in a gas-tight manner with the enclosing walls 2, is provided underneath the gas outlet represented by the openings 8. It represents the boiler ceiling and at the same time forms the lower boundary of a gas collecting chamber 11, into which the openings 8 open.

Exchangeable ceramic tubular filter elements 12 are suspended in the plate 10. The filter elements 12 are closed at one side and project by their closed end into the interior of the combustion chamber. The open upper end of the filter elements 12 penetrates the plate 10 and projects into the gas collecting chamber 11.

A closable duct 13, which is connected with a dust separator, for example with a cyclone 14, is connected at one or at two of the enclosing walls 2 underneath the plate 10. This duct 13 is opened from time to time in order to let out a part of the flue gases which have become strongly enriched with dust in the region of the filter elements 12. For the case that a solid filter cake deposits on the filter elements 12, a cleaning-off device is to be provided above the plate 10.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. Combustion chamber for the combustion of solid fuels, particularly under increased pressure, comprising: dust removal means; a gas outlet arranged at an upper end of the combustion chamber and adjoined by said dust removal means; said dust removal means comprising a plurality of tubular ceramic filter elements open at one side and suspended at a plate arranged before said gas outlet and forming the ceiling of the combustion chamber; a closable duct connected with a dust separator, said closable duct being connected to said combustion chamber underneath said plate.

2. Combustion chamber for the combustion of solid fuels, particularly under increased pressure, comprising: dust removal means; a gas outlet arranged at an upper end of the combustion chamber and adjoined by said dust removal means; said dust removal device comprising a plurality of tubular ceramic filter elements open at one side and suspended at a plate arranged before said gas outlet and forming the ceiling of the combustion chamber, gases carrying dust passing through said filter elements and being separated from the dust at a closed side of said filter elements.

3. Combustion chamber according to claim 1, including a gas collecting chamber having a gas duct at two opposite sides and arranged above said plate.

* * * * *